US005390586A

United States Patent [19]

Jones

[11] Patent Number: 5,390,586

[45] Date of Patent: Feb. 21, 1995

[54] SELF-BLEEDING HYDRAULIC CYLINDER

[76] Inventor: Peter D. Jones, Rte. 1, Box 202, Garden City, Minn. 56034

[21] Appl. No.: 219,291

[22] Filed: Mar. 28, 1994

[51] Int. Cl.[6] ..... F15B 21/04

[52] U.S. Cl. ..... 92/79; 92/51; 92/52; 91/167 R

[58] Field of Search ..... 92/79, 51, 52, 53; 91/167 R, 169

[56] References Cited

U.S. PATENT DOCUMENTS

| | | | |
|---|---|---|---|
| 2,453,350 | 11/1948 | Stegeman . | |
| 2,505,213 | 4/1950 | Schnell . | |
| 2,588,285 | 3/1952 | Pelouch . | |
| 2,783,744 | 3/1957 | Tennis . | |
| 2,811,950 | 11/1957 | Entz | 92/79 |
| 2,830,859 | 4/1958 | Parsons . | |
| 3,136,221 | 6/1964 | Walker . | |
| 3,147,829 | 9/1964 | Johnson et al. . | |
| 33,168,853 | 2/1965 | Prince . | |
| 3,203,317 | 8/1965 | Taylor | 92/79 |
| 3,398,645 | 8/1968 | Nansel . | |
| 3,415,169 | 12/1968 | Naddell . | |
| 3,496,838 | 2/1970 | Barrett et al. . | |
| 3,610,100 | 10/1971 | Hoffman . | |
| 3,625,297 | 12/1971 | Worman . | |
| 3,832,937 | 9/1974 | Moore et al. . | |
| 3,956,970 | 5/1976 | Kupiek et al. . | |
| 4,691,617 | 9/1987 | Purkott . | |
| 4,726,281 | 2/1988 | De Filippi . | |
| 5,191,828 | 3/1993 | McCreery . | |
| 5,247,872 | 9/1993 | Hoshi . | |

FOREIGN PATENT DOCUMENTS

| | | | |
|---|---|---|---|
| 2316105 | 1/1977 | France | 92/79 |
| 180486 | 10/1935 | Switzerland | 92/53 |

*Primary Examiner*—Thomas E. Denion
*Attorney, Agent, or Firm*—Myers, Liniak & Berenato

[57] ABSTRACT

A self-bleeding multi-stage or single-stage hydraulic cylinder system is disclosed which automatically bleeds entrapped air from within the cylinder each time the cylinder is cycled. The self-bleeding structure preferably includes a fixed elongated tube mounted to the base plate of the cylinder, and an axially moveable elongated tube telescopically mounted on the fixed tube. A biasing compression spring forces the moveable tube upward to a predetermined extent when the cylinder is extended. Upon contraction of the cylinder, air trapped therein is purged or bled from the cylinder through the top end of the axially moveable elongated tube into a fluid reservoir. In the final stage of contraction of the cylinder, hydraulic fluid is forced through the fixed and moveable elongated tubes thereby forcing the remaining air trapped therein out of the cylinder and into the hydraulic fluid reservoir.

13 Claims, 11 Drawing Sheets

SELF-BLEEDING HYDRAULIC CYLINDER

This invention relates to hydraulic cylinders. More particularly, this invention relates to self-bleeding hydraulic cylinders of the single-stage or multi-stage type.

BACKGROUND OF THE INVENTION

This invention is applicable to both multi-stage and single-stage hydraulic cylinders useful in a wide variety of environments. An environment found particularly useful, and in which hydraulic cylinders are widely used, is the trucking industry where dump bodies must be raised and lowered.

A long recognized problem associated with both single-stage and multi-stage hydraulic cylinders is the accumulation of air or gas within the cylinder. The presence of this trapped air or gas is undesirable because the entrapped air will, when compressed under load, sometimes result in a somewhat erratic and thus undesirable operation. Heretofore it has been conventional to employ bleeders or channels extending from the highest entrapment point in the hydraulic cylinder to remove or "bleed" the accumulated gas or air from the cylinder. While these "bleed" systems have generally accomplished their intended result, they tend to be somewhat messy and time consuming to use.

One of these known bleeder systems, generally applicable to both single stage and multi-stage hydraulic cylinders, provides a small hole in the top of the final or smallest stage to which the upper pivot assembly is welded. A screw-in type plug is then typically located in the hole just below the upper pivot shaft. The purpose of the hole and screw-in plug is to allow the trapped air in the top of the cylinder to escape when the plug is loosened. This, in turn, allows the hydraulic fluid to enter the line or reach the hole. Then, tightening the plug only when the hydraulic fluid is present at the top of the cylinder or slightly spills therefrom, ensures that undesired air has been fully "bled" from the cylinder. This "bleeding" process must be done with the multi-stage cylinder partially extended, and can be a difficult and messy experience. Furthermore, this known "bleeding" process must be done repeatedly, virtually each time any significant amount of air is allowed to enter the cylinder from any one of a number of avenues, such as via less than perfect seals, faulty hydraulic lines, or through the hydraulic fluid reservoir.

Another known solution to the problem of air or gas entrapment involves attaching a small pressure hose with a control valve therein to the aforesaid bleed hole located at the top of the cylinder. The pressure hose connected to the bleed hole is then run down the front of the cylinder to a more convenient and accessible location, thereby allowing the bleeding process to be carried out without having to unscrew a plug at the top of the cylinder. The problems of spillage and the need for frequent bleeding are still presented.

FIGS. 1–2 exemplify a typical prior art multistage telescopic hydraulic cylinder which includes a type of bleeder system as described above. The multi-stages are in compressed or retracted form as shown in FIG. 1. The hydraulic cylinder includes outer cylinder 1 fixedly attached to base plate 21, inner cylinder 3, first intermediate cylinder 5, and second intermediate cylinder 7. Cylinders of this type are typically mounted in linkage frames, or directly to truck chassis and dump truck bodies.

Such telescopic hydraulic cylinders are usually, but not always, mounted with largest stage i fixedly mounted to base plate 21 and with smallest stage 3 axially extendable relative thereto. It is, of course, possible to invert the cylinder shown in FIGS. 1–2 so that the inner or smallest stage cylinder is fixedly mounted to a base plate and the outer or larger cylinder is axially moveable with respect thereto. In many instances, however, it is the top end of inner cylinder 3 which is typically pivotally attached to the load to be moved via pivot member 15.

In use, hydraulic fluid is pumped into base port attachment tube 25 and through base plate 21 via entrance orifice 23 using conventional hydraulic control mechanisms (e.g. power take-off device, spool valve, pumps, reservoir, and control valve systems). By pumping hydraulic fluid into and filling cylinder interior 9, largest moving stage 5 is caused by the pressure of the hydraulic fluid, to extend upward. As hydraulic fluid continues to be pumped via entrance orifice 23 into cylinder interior 9, first moving stage 5 will reach a stop at the end of its stroke, and the next moving stage (intermediate cylinder 7) will then begin to extend upward. Upon intermediate stage 7 reaching a stop at the end of its stroke, the last moving stage (inner cylinder 3) will move upward thereby extending the vertical position of pivot attachment 15 affixed to cylinder cap 17 so as to move the load attached to the cylinder to its uppermost limit. The hydraulic cylinder retracts in reverse stage order, with inner cylinder 3 first descending, then intermediate cylinder 7, and so on as fluid is forced from interior 9 of the cylinder by weight of the load via orifice 23.

Because of air that has become entrapped at the end 29 of cylinder interior 9, fluid level 27 is only permitted to reach a height dictated by the amount of air (or gas) so entrapped in the cylinder. It is well-known in the art that the trapped air in end pocket 29 interferes with the proper performance of both multi-stage and single stage cylinders. It is generally believed that this is due to the air being compressible and the fluid being relatively incompressible, causing the cylinder and thus the load to jerk or bounce as it is elevated during cylinder expansion.

The "bleeding" process for purging the trapped air from the prior art cylinder shown in FIG. 1 is accomplished via bleed-hole 11 disposed in the cylinder cap 17 and its corresponding screw plug 13. The bleeding is carried out by removing screw plug 13 from bleed-hole 11 and allowing the trapped air in the cylinder to escape upwardly through bleed-hole 11. After all of the air has escaped from the cylinder, screw plug 13 is reinserted into bleed-hole 11, but only when hydraulic fluid is present at the top of the cylinder adjacent bleed-hole 11 (or slightly overflowed) thereby ensuring that substantially all air within the confines of the cylinder has been removed. This process must, of course, be carried out with the cylinder partially extended thereby making the process both inconvenient and time consuming. Any spillage of fluid creates a clean-up problem.

FIGS. 3(*a*) and 3(*b*) illustrate prior art base plate 21 of the multi-stage cylinder shown in FIGS. 1–2. Base plate 21 defines entrance orifice 23 in a non-concentric position with respect to the base plate's outer periphery. Entrance orifice 23 acts as a hydraulic fluid passageway between interior 9 of the hydraulic cylinder and the hydraulic fluid reservoir (not shown). The hydraulic fluid, upon being pumped toward the cylinder from the reservoir, flows through orifice 23 in base plate 21 and into interior 9 of the prior art hydraulic cylinder of FIGS. 1–2.

Entrance orifice 23 is disposed at a non-central position due to the presence of pivot 30 attached to the bottom or exterior side of base plate 21. Pivot 30 is attached to the base plate at a central area thereof exterior the cylinder, rendering it difficult for the fluid to enter base plate 21 at the central area occupied by pivot 30. Accordingly, the hydraulic fluid enters the base plate and cylinder at the non-central location defined by orifice 23. Beveled portion 28 of the base plate accommodates the lower end of outer cylinder 1. Conventional pivot 30 is not shown in FIG. 3(*b*) for the purpose of simplicity.

U.S. Pat. No. 3,496,838 discloses a self-purging or self-bleeding hydraulic cylinder including a piston enclosed therein. In this patent, a flanged tubular purging element is coaxially secured to the base of the piston inside the cylinder. The flanged portion bears on a cup-type gasket and sandwiches the gasket between the piston base and flange, and a hollow tubular portion of the purging member depends axially downward from the flanged portion. The flanged portion has a diameter substantially less than the base of the piston. The flanged portion is radially penetrated by a plurality of radially extending orifices which communicate with the axial opening of the hollow tubular depending portion, thereby allowing compressed air to be bled from the cylinder via the orifices in the flange and the axial opening in the hollow tubular portion during contraction of the cylinder.

Further examples of known bleed systems are found in U.S. Pat. Nos. 2,588,285; 3,496,838; and 5,191,828. The bleed system of U.S. Pat. No. 2,588,285 is adapted to be used in conjunction with a single stage hydraulic cylinder including a fixed tube disposed therein. This system is fairly complex in that it requires an additional bleed tube disposed in the annular space between the inner and outer cylinders.

Aforesaid U.S. Pat. No. 3,496,838 requires the presence of a piston within the hydraulic cylinder. This is undesirable due to the fact that many commercial hydraulic cylinders avoid the use of pistons disposed therein.

U.S. Pat. No. 5,191,828 discloses a single stage hydraulic cylinder having a bleeding system therein, the bleeding system being of a highly complex nature. The large number of moving parts of this design renders it difficult to manufacture.

It is apparent from the above that there exists a need in the art for a simple, cleaner-to-operate, and inexpensive self-bleeding mechanism adaptable to use in both multi-stage and single-stage hydraulic cylinders, wherein the air trapped within the interior of the cylinder is automatically bled or purged therefrom each time the cylinder is cycled.

SUMMARY OF THE INVENTION

Generally speaking, this invention fulfills the above-described needs in the art by providing a self-bleeding extendable and retractable hydraulic cylinder system comprising:

a base plate having attached thereto a first stationary cylinder and having located therein an orifice in communication with one axial end of the cylinder;

a second cylinder coaxial with the first cylinder and extendable with respect to the first cylinder, the second cylinder having in one end thereof a pocket within which air may become entrapped;

a self-bleeding mechanism disposed within the hydraulic cylinder system for enabling entrapped air to escape from the pocket, the self-bleeding mechanism including a first stationary conduit means, the first conduit means having a first end fixedly attached to the base plate, the orifice in the base plate in communication with the first conduit means, a second conduit means coaxial with the first conduit means, the second conduit means being extendable and retractable with respect to the first conduit means and being opened to flow communication at both its ends; and biasing means for extending the second conduit means to a predetermined extended position relative to the first conduit means such that when the hydraulic cylinder system is being retracted from an extended position one end of the second conduit means will be in communication with the pocket for enabling entrapped air to bleed from the hydraulic cylinder system.

In certain preferred embodiments of this invention, the first conduit means of the self-bleeding mechanism includes a fixed elongated tube having its bottom end affixed to the base plate, the second conduit means includes an axially moveable elongated tube telescopically connected to the fixed elongated tube, and the biasing means includes a spring which biases the axially moveable elongated tube upwardly away from the base plate to the predetermined extended position when the hydraulic cylinder is in the extended state.

This invention will now be described with reference to certain embodiments thereof as illustrated in the following drawings.

IN THE DRAWINGS

FIG. 3(*b*) is a top view of the base plate of FIG. 3(*a*).

FIG. 6(*b*) is a top view of the base plate of FIG. 6(*a*).

FIG. 7(*b*) is a side view of the circular plate of FIG. 7(*a*).

FIG. 8(*b*) is a top view of the combination of the base plate and circular plate of FIG. 8(*a*).

DETAILED DESCRIPTION OF CERTAIN EMBODIMENTS OF THIS INVENTION

Referring now more particularly to the accompanying drawings in which like numerals indicate like parts throughout the several views.

Figure 4:
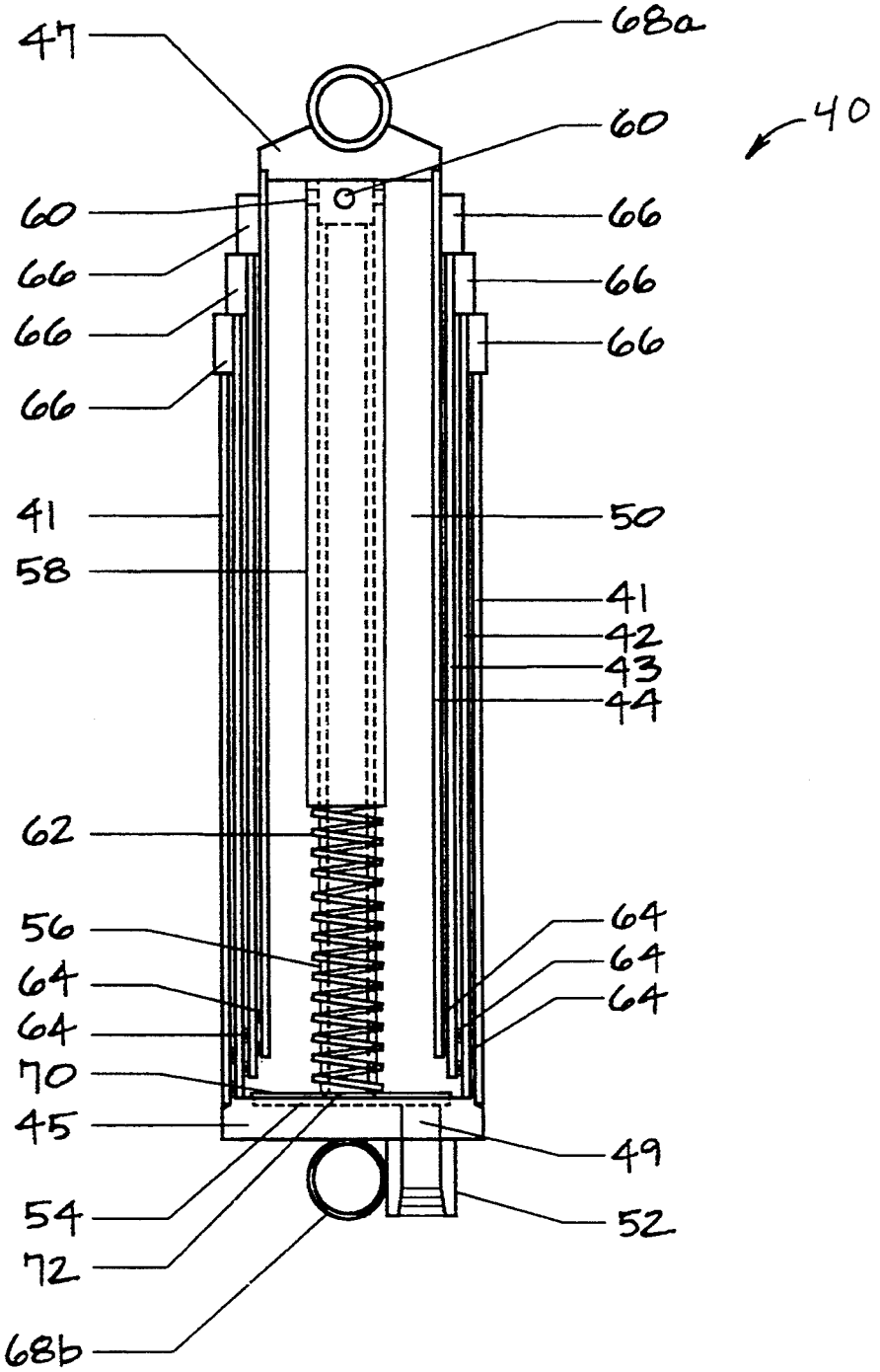
FIG. 4 is a longitudinal vertical sectional view of a multi-stage self-bleeding hydraulic cylinder according to a first embodiment of this invention, in its retracted or unexpanded form.
Figure 5:
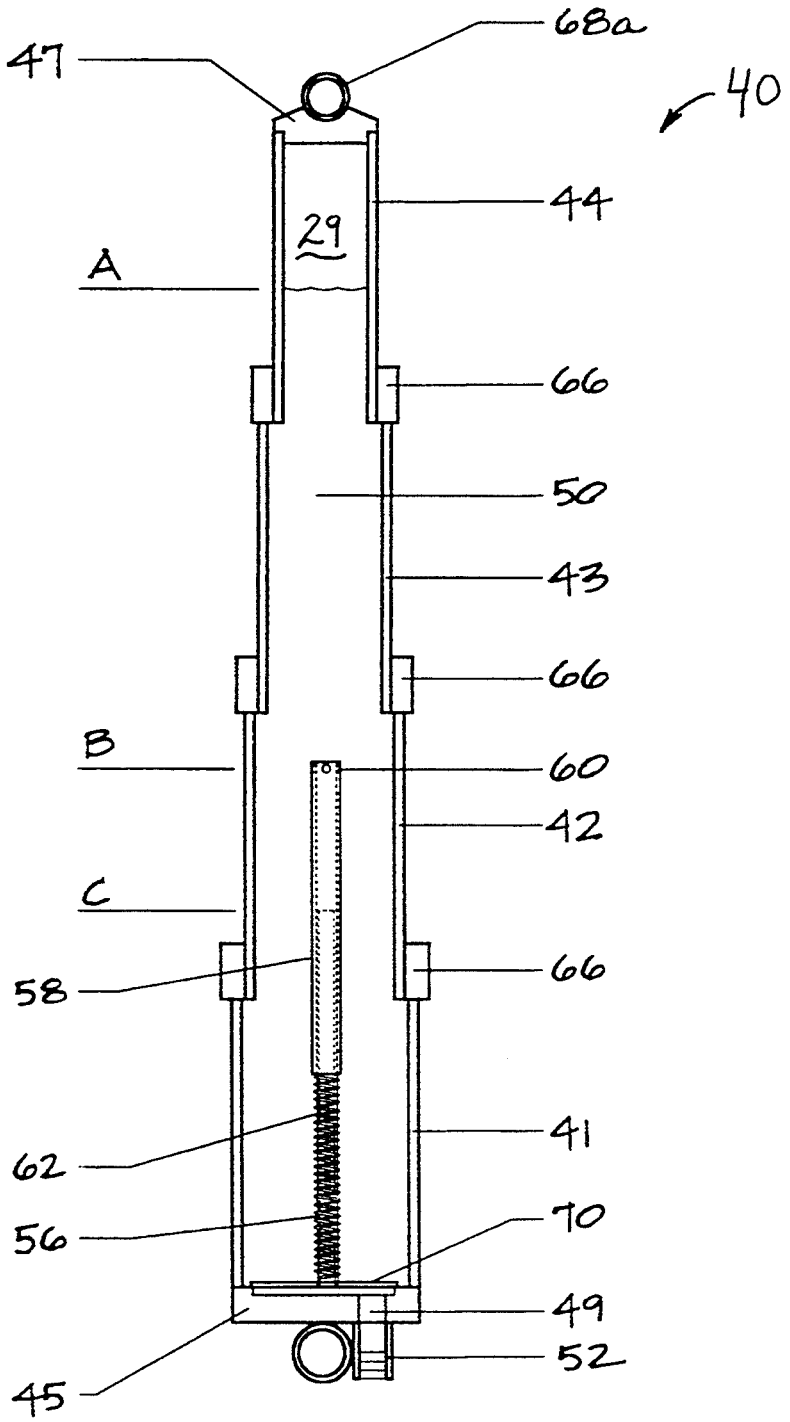
FIG. 5 is a longitudinal vertical sectional view of the multi-stage self-bleeding hydraulic cylinder of FIG. 4, in its fully extended form.

FIGS. 4–5 are vertical sectional views of a multi-stage self-bleeding hydraulic cylinder system 40 according to a first embodiment of this invention. The hydraulic cylinder system includes a four stage telescopic hydraulic cylinder which, in FIG. 4, is shown in its fully retracted or unextended position and in FIG. 5 in its fully extended position.

Self-bleeding cylinder system 40 includes outer or first stage cylinder 41 encircling second stage cylinder 42, third stage cylinder 43, and inner or fourth stage cylinder 44. Second stage cylinder 42 and third stage cylinder 43 may also be referred to as intermediate stage cylinders. The vertical or axial length of outer cylinder 41 is less than that of second stage cylinder 42, which in turn is less than the axial length of third stage cylinder 43, with inner cylinder 44 having the greatest axial length of all of the stage cylinders.

Outer stage cylinder 41 is fixedly attached (preferably welded) to base plate 45, while second and third stage cylinders, 42 and 43 respectively, as well as inner cylinder 44 are axially movable relative to one another and to outer cylinder 41. As shown, the four stage cylinders 41–44 are substantially co-axial and concentric.

Fixed outer cylinder 41 is closed at its lower or bottom end as by base plate 45. Base plate 45 defines an entrance orifice 49 extending therethrough. Hydraulic fluid from a conventional fluid reservoir (not shown) is pumped into interior 50 of multi-stage self-bleeding hydraulic cylinder system 40 through entrance orifice 49 in base plate 45 using aforesaid conventional hydraulic control mechanisms (not shown). Base plate port attachment 52 is provided on the exterior side of base plate 45 adjacent entrance orifice 49. The purpose of port attachment 52 is to allow a conventional hydraulic fluid hose (not shown) to be attached to the base plate so as to communicate with orifice 49 extending therethrough. The hydraulic fluid hose, of course, provides a fluid passageway between entrance orifice 49 and the fluid reservoir and allows hydraulic fluid to flow therebetween.

Figure 6A:
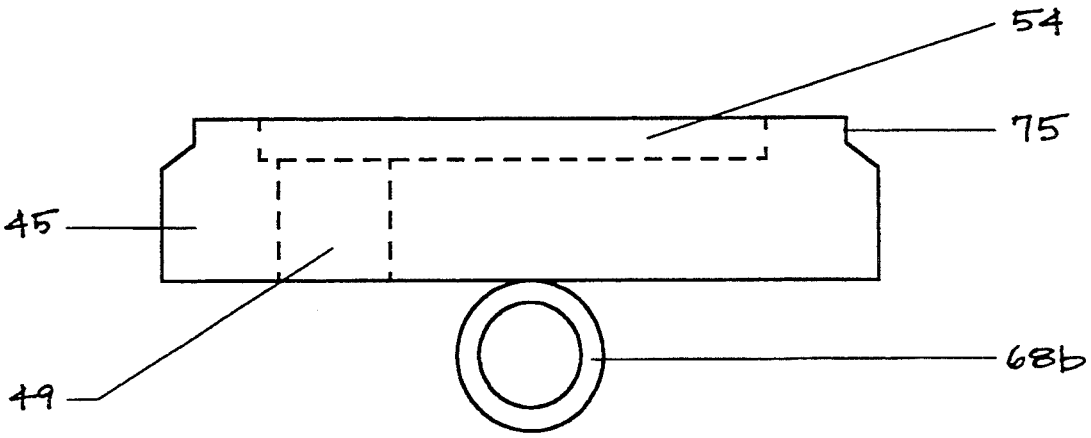
FIG. 6(*a*) is a side view of the base plate used in the hydraulic cylinder of both the first and second embodiments of this invention.
Figure 6B:
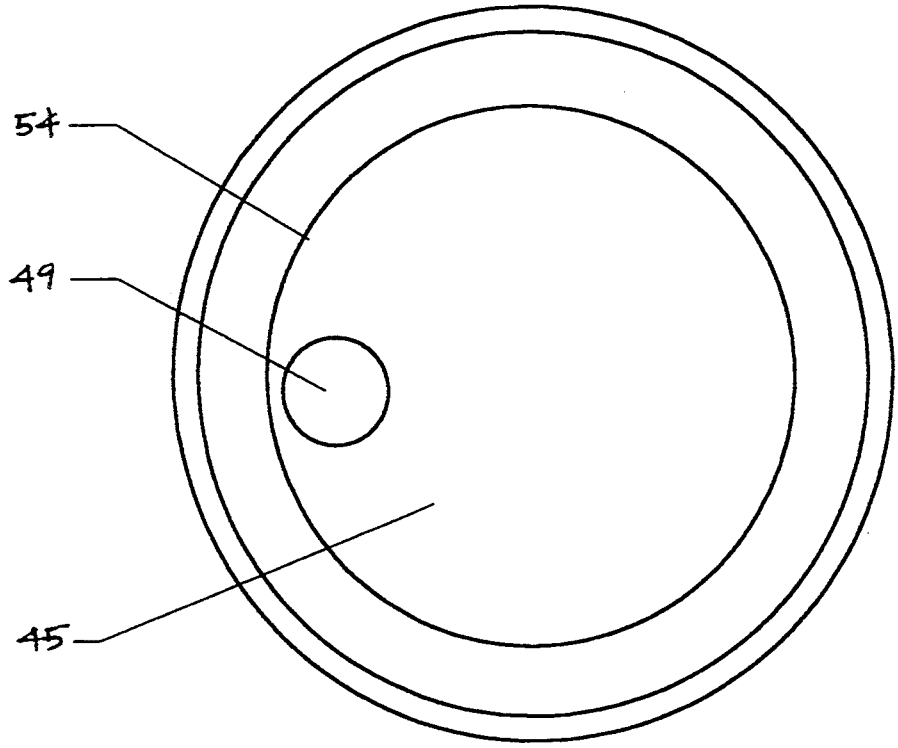

With reference to FIGS. 6(*a*)–6(*b*), and 7(*a*)–(*b*), base plate 45 includes a circular cut-away or step-down area 54 tooled therein. The purpose of cut-away area 54 is to allow entering fluid from attachment 52 and entrance orifice 49 to flow through cut-away area 54 into first, fixed bleed conduit tube 56 via orifice 72 in circular plate 70 connected to the top side of base plate 45. As can be seen, when fluid is pumped into interior 50 of hydraulic cylinder system 40 to extend the stage cylinders, the hydraulic fluid will enter the cylinder system through entrance orifice 49, then proceed via cut-away area 54 and orifice 72 into fixed elongated air-bleeder tube 56. From tube 56, open at its upper end, the fluid will next proceed into the top end of extendable and retractable conduit tube 58. At this top end of conduit tube 58, orifices 60 are provided. The fluid flows out of orifices 60 and into the interior of the stacked cylinder system to fill it and thus commence the sequential expansion of cylinders 42–44 respectively.

Inner cylinder 44, as well as second and third stage cylinders 42 and 43, each have ring bearing members 64 affixed to their exterior peripheries near the bottom ends thereof. These ring bearings 64 at the lower ends of stacked or staged cylinders 42–44 cooperate with stops 66 fixed to outer stage cylinder 41, second stage cylinder 42, and third stage cylinder 43. Stops 66 affixed to cylinders 41–43 act to limit the extending or upward movement of axially moveable stage cylinders 42–44 which have sealing rings 64 attached thereto.

As second stage cylinder 42 (the largest and first stage cylinder to move upward when fluid is pumped into interior 50 of the hydraulic cylinder via orifices 60) extends upwardly, sealing rings 64 affixed thereto come into contact with stop member 66 thereby limiting the upward movement of second stage cylinder 42. Likewise, the upward movement of third stage cylinder 43 is limited when rings 64 attached thereto come into contact with stop 66 affixed to second stage cylinder 42. The upward movement of inner cylinder 44 is limited in a similar manner by rings 64 attached thereto and stop 66 fixedly attached to third stage cylinder 43.

Inner cylinder 44 is open at its bottom end and sealingly closed at its top end by cylinder cap 47. Cylinder cap 47 seals the top end of the multi-stage hydraulic cylinder stack and is provided with a pivot member 68*a* attached thereto. Typically, member 68*a* is used to bear the load to be moved by the multi-stage hydraulic cylinder stack (e.g. the dump bed of a truck). Another pivot mounting member 68*b* is preferably fixedly connected to the exterior surface of base plate 45 thereby enabling the multi-stage hydraulic cylinder stack to be pivotally mounted at both axial ends.

It is now clear that in operation, when hydraulic fluid under pressure is directed by the operator, from a pump (not shown), under pressure through port attachment 52 into interior 50 of cylinder system 40 via orifices (ports) 60, the three axially movable stage cylinders 42–44 are caused to extend upwardly and sequentially so long as fluid under pressure continues to be directed into interior 50 of the cylinder. When second stage cylinder 42 reaches the end of its stroke, cylinders 43 and 44 continue to extend upward as fluid is pumped into hydraulic cylinder interior 50. Accordingly, inner cylinder 44 continues upwardly when third stage cylinder 43 reaches the end of its stroke. As illustrated in FIG. 5, air may well have become entrapped during this operation, thus forming air pocket 29.

Referring still to FIGS. 4–5, elongated conduit tube 56 is fixedly attached (preferably welded) to the top side of circular plate 70 which is affixed (preferably welded) to base plate 45. Fixed elongated tube 56 has its interior cavity positioned over and coaxial to orifice 72 defined in circular plate 70 so as to allow hydraulic fluid to flow between fixed tube 56 and entrance orifice 49 in the base plate via cut-away area 54. Fixed elongated tube 56 extends axially upwardly through the center of concentric stage cylinders 41–44 for a distance slightly less than the available length between plate 70 and cylinder cap 47 when the multi-stages of this embodiment are in their fully retracted positions as shown in FIG. 4.

Compression spring 62, or another conventional biasing member, fits closely over the exterior periphery of fixed tube 56 and is installed so as to rest against the top or upper surface of circular plate 70. The length of spring 62 when it is not under compression may be, for example, equal to approximately two-thirds the axial length of fixed tube 56.

Axially movable conduit tube 58 is provided with an inner diameter slightly greater than the exterior diameter of fixed tube 56, thereby enabling movable tube 58 to slidably fit over fixed tube 56 and slide axially relative thereto when forced to do so by compression spring 62 or in reverse, by cap 47 as the cylinders retract to their resting position. Moveable elongated tube 58, which preferably has an axial length substantially equal to about two-thirds the axial length of fixed tube 56 in this embodiment, is positioned over fixed tube 56 so as to rest on top of spring 62. A close telescoping fit is preferably provided between fixed tube 56 and axially moveable tube 58.

When the multi-stages of hydraulic cylinder system 40 are in their fully retracted form as shown in FIG. 4, cylinder cap 47 attached to the upper end of inner cylinder 44 contacts the open upper end of movable tube 58 thereby holding moveable tube 58 down over fixed tube 56 against the force of compression spring 62. Moveable tube 58 as aforesaid, has cross drilled orifices 60 at its top end which allow hydraulic fluid to flow to and from cylinder interior 50 via entrance orifice 49 in the base plate when the cylinder cap is sealing the upper end of tube 58.

In a typical operation when multi-stage cylinder system 40 is installed, for example, as part of a truck hoist assembly beneath a dump bed on a truck (see FIG. 11), the dump truck operator first activates power take-off device (PTO) 115 by way of lever 117 in the cab. PTO 115, when engaged with the vehicle transmission, powers hydraulic pump 119 which circulates hydraulic fluid under pressure within the hydraulic system awaiting direction to do work. To raise dump bed 102, the dump truck operator then actuates, via lever 121 in the cab, valve 123 disposed on or adjacent hydraulic pump 119. Actuation of valve 123 to the "raise" position causes the hydraulic fluid to be directed via valve 123 and hydraulic line 125 to entrance orifice 49 in the base plate of hydraulic cylinder 100.

After entering orifice 49, the fluid flows through cut-away area 54 and through orifice 72 defined by circular plate 70. The fluid proceeds through orifice 72 and into the interior of fixed elongated conduit tube 56. The pumped fluid travels upward through fixed tube 56 into axially moveable elongated tube 58. When the fluid reaches to the top end of axially moveable tube 58, it exits moveable tube 58 via orifices 60 and flows into interior 50 of the hydraulic cylinder. When interior 50 fills with hydraulic fluid, the entrapped air is forced to the top of the cylinder and moveable stage 42, having the largest surface area, is caused to extend upward.

As axially moveable stage cylinders 42–44 proceed upwardly together as described above, compression spring 62 pushes axially moveable tube 58 upwardly, for example, to an extent of about one-third the length of fixed tube 56, i.e., until spring 62 is no longer compressed. From this point, moveable staged cylinders 42–44 continue to extend upwardly to the end of their total strokes with cylinder cap 47 no longer in contact with moveable tube 58. The final configuration, of course, is that all stages are fully extended. This is shown in FIG. 5. When cylinder cap 47 becomes axially spaced from the upper end of axially moveable tube 58, hydraulic fluid continues to enter interior 50 of the cylinder via orifice 60 and the open top end of tube 58, extending the cylinder stack until the last stop is reached. Of course, if the operator so desires he can stop the extension of the cylinders at any point merely by placing the pump valve in the neutral position which prohibits fluid flow to or return from interior 50.

When the cylinder stages reach an extended position somewhere above the limit of extension of tube 58, air trapped in interior 50 of the multi-stage hydraulic cylinder stack will have risen to the top and will have been compressed in pocket 29, e.g. above level "A" as shown in FIG. 5. Reference "A" in FIG. 5 represents, of course, an exemplary or typical level that the hydraulic fluid will reach when all stages of cylinder 40 are fully extended and the cylinder has yet to have been bled.

To lower dump bed 102 and bleed the entrapped air from the interior of the hydraulic cylinder, the operator merely shifts pump valve 123 to the "lower" position. This causes entrance orifice 49 to communicate with fluid reservoir 127 by way of pump 119 and allows the weight of dump bed 102 in this embodiment to force the fluid out of the cylinder thereby causing the hydraulic cylinder to retract and lower the dump bed. Accordingly, the hydraulic fluid and entrapped air are purged from pump 100 and make their way back to reservoir 127 by way of return line 129 disposed between the reservoir and valve 123.

When the hydraulic cylinder stack begins to retract under the weight of dump bed 102, the hydraulic fluid in the cylinder between levels "A" and "B" is forced through open top ports (i.e. orifices) 60 of moveable tube 58, downwardly through the interior of fixed tube 56, out aperture 70 into cut-away area 54 and eventually back, to reservoir 127 via orifice 49. When multi-stage cylinder stack 40 retracts to the position where level "A" and level "B" are the same, i.e. where the lower edges of orifices 60 emerge into air pocket 29, the entrapped and compressed air in pocket 29 is forced out of the cylinder stack through orifices 60, following the same path which the fluid did back to reservoir.

Further retraction of the cylinder stack causes cylinder cap 47 to finally contact the open top axial end of movable tube 58. At this point, substantially all of the entrapped air in pocket 29 will have been bled therefrom. From this point, as the cylinder stack continues to retract, the hydraulic fluid between levels "B" and "C" i e where level "C" is substantially adjacent the top end of fixed elongated tube 56, is forced through cross drilled orifices 60 defined in moveable tube 58 and downward through bleed tubes 58 and 56 into hydraulic fluid reservoir 127, thus flushing out the compressed air remaining in bleed tubes 56 and 58 and forcing it back into reservoir 127 via aforesaid hydraulic lines 125 and 129.

Preferably, the design of cylinder system 40 allows enough fluid (twice as much in a preferred embodiment) to be present between levels "B" and "C" so as to ensure that the air entrapped within tubes 56 and 58 when cap 47 comes into contact with the open upper end of tube 58 is flushed all the way back to reservoir as stages 42–44 retract to their fully retracted position. In other words, spring 62 in its expanded form forces tube 58 to an extended position sufficient to allow the volume of fluid disposed between levels "B" and "C" to be large enough in order to "chase" the air trapped within tubes 56 and 58 when cap 47 contacts tube 58 all the way back through valve 123 into reservoir 127 via return line 129.

During the stage of retraction when cylinder cap 47 is contacting the open top end of moveable tube 58, compression spring 62 is compressed during the descent of stage cylinders 42–44 as elongated axially moveable tube 58 retracts downward telescoping over fixed elongated tube 56. Accordingly, the cylinder retracts until the multi-stages of hydraulic cylinder 40 are in fully retracted form (or until truck dump body 102 is at rest on the truck frame). Preferably, dump bed 102 comes to rest on the truck frame before largest axially moveable stage cylinder 42 comes to rest on base plate 45, thereby allowing the truck frame to support dump bed 102 instead of requiring the hydraulic cylinder to do so.

When the cylinder has been retracted as described above, the air which had been trapped inside of the cylinder within pocket 29 has been replaced with hydraulic fluid because the trapped air has been purged or bled from interior 50 of the hydraulic cylinder system 40 during the latter period of cylinder retraction. It is possible, however, that after this initial bleeding operation, a small amount of air may still remain in certain circumstances within cylinder system 40 in the form of air bubbles and/or further leakage of air which may occur. Nevertheless, each time the multi-stages of cylinder system 40 are extended and retracted (or cycled), any significant amount of air entrapped will simply be bled therefrom thus maintaining the entrapped air at acceptable levels throughout the useful life of the cylinder system. Accordingly, this invention may properly by designated as an automatic self-purging or self-bleeding system.

In this respect, the automatic self-bleeding nature of the cylinder systems according to this invention allows, for example, a dump truck operator, by simply raising and lowering the dump bed, usually when not under load and before each days operations, to bleed any significant amount of entrapped air from within the cylinder system. Thereafter, because the cylinder system is bled substantially free of entrapped air each time it is cycled, any tendency toward jerky or bouncy movement of the cylinder is substantially reduced or eliminated.

Reference now is made to a particularly preferred base plate arrangement contemplated by this invention. FIG. 6(*a*) is a side view of base plate 45 of the first embodiment of this invention. FIG. 6(*a*) illustrates cut-away area 54 and entrance orifice 49 defined by base plate 45. Base plate 45 also has a beveled edge portion 75 which accommodates the lower axial end of outer stage cylinder 41.

Figure 1:
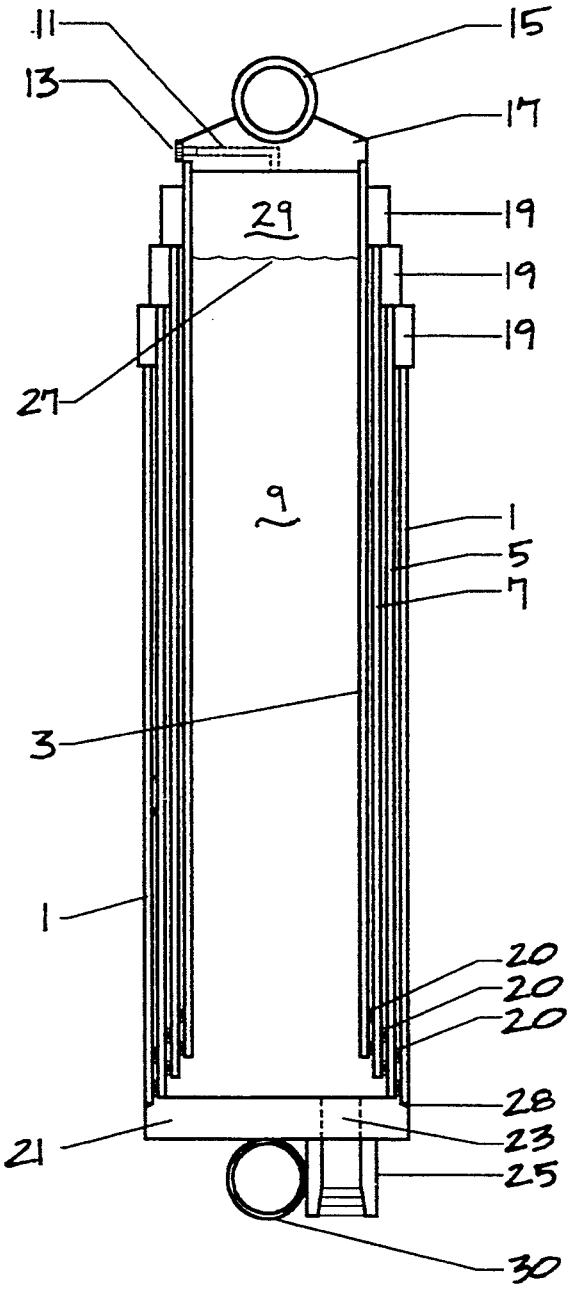
FIGURE 1 (PRIOR ART)
FIG. 1 is a longitudinal vertical sectional view of a prior art multi-stage hydraulic cylinder having a bleed hole at a top end thereof.
Figure 2:
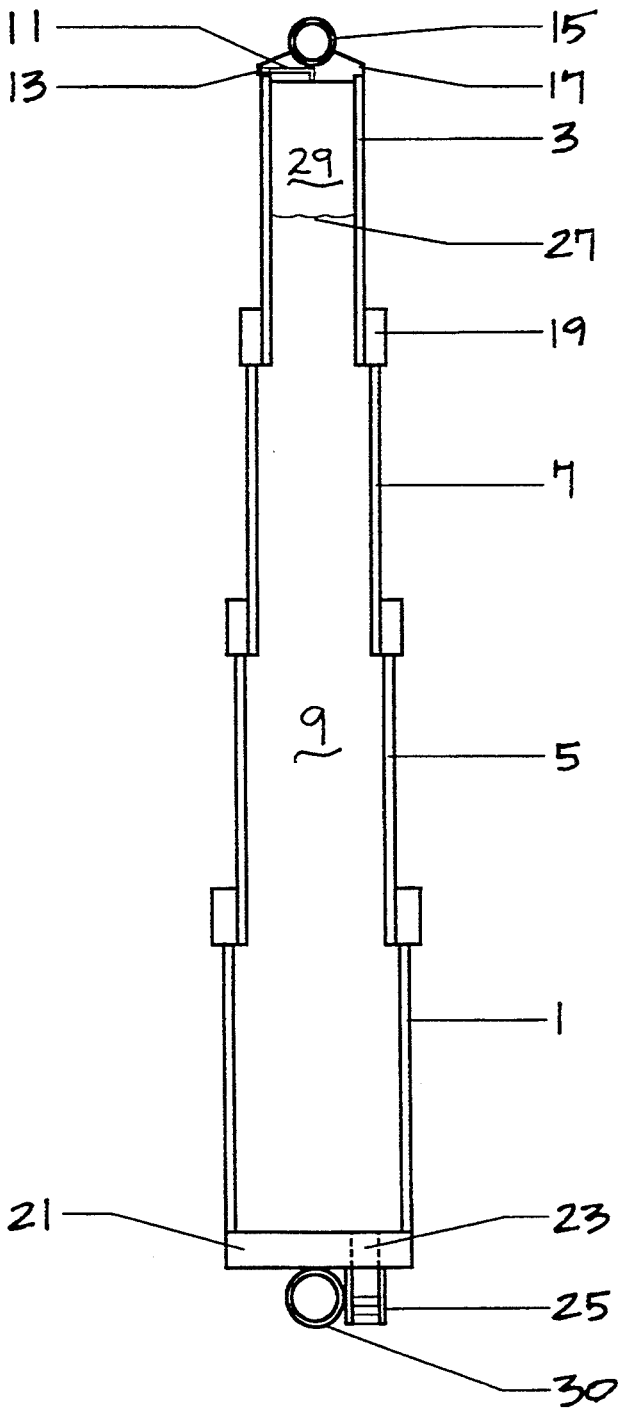
FIGURE 2 (PRIOR ART)
FIG. 2 is a longitudinal vertical sectional view of the prior art multi-stage hydraulic cylinder of FIG. 1 in its fully extended form.
Figure 3A:
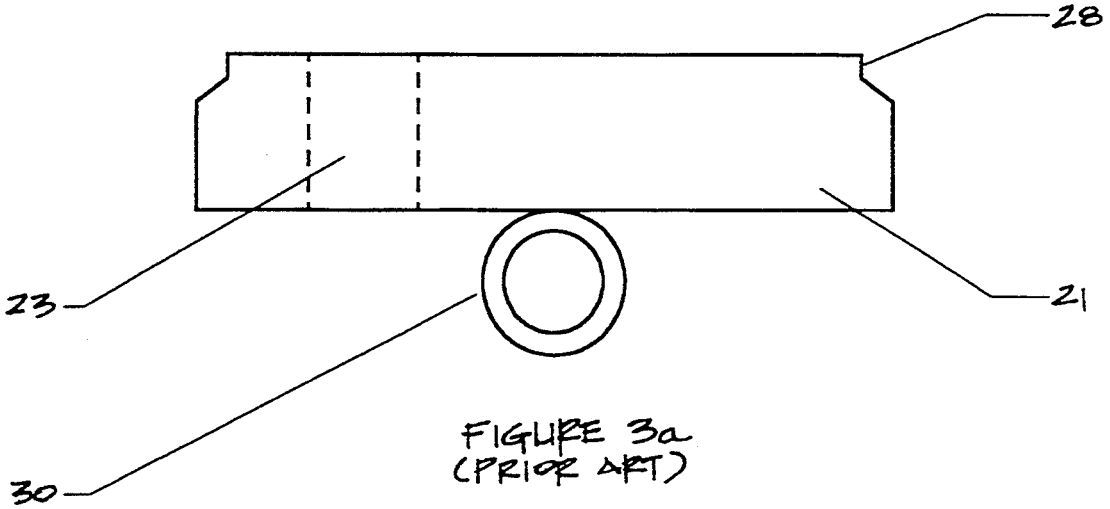
FIGURE 3a (PRIOR ART)
FIG. 3(*a*) is a side view of the prior art base plate used in the prior art hydraulic cylinder of FIGS. 1–2.
Figure 3B:
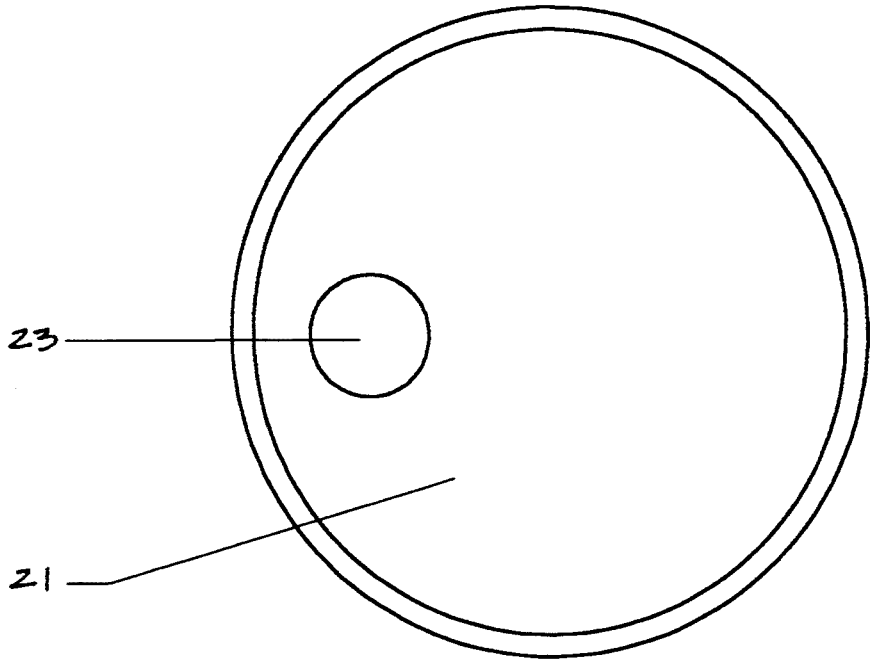
FIGURE 3b (PRIOR ART)

In the first embodiment of this invention, it is important due to the coaxial positions of fixed and moveable elongated bleed tubes 56 and 58 relative to stage cylinders 41–44, that the hydraulic fluid under pressure be introduced (and extracted) into the cylinder at approximately the radial center of base plate 45. Accordingly, the base plate of the prior art (FIGS. 3(*a*)–3(*b*)) must be modified in that cut-away area 54 shown in FIGS. 6(*a*) and 6(*b*) is added so that off center entrance orifice 49 in base plate 45 communicates with the interiors of the fixed and moveable elongated bleeding tubes 56 and 58. This interface is made possible by orifice 72 defined in circular plate 70 which is disposed between fixed bleed tube 56 and base plate 45. The circular cut-away area 54 is provided so that hydraulic fluid may flow from entrance orifice 49 into the interior portions of the fixed and moveable elongated tubes 56 and 58 via orifice 72 in circulate plate 70. This design of base plate 45 allows for pivot mount 68*b* to be simply affixed to the lower or exterior surface of base plate 45 at a central location thereof, thereby providing for a stable and simplistic mounting of hydraulic cylinder 40.

FIG. 6(*b*) is a top view of base plate 45 shown and described in aforesaid FIG. 6(*a*). As can be seen, cut-away area 54 is substantially circular in design as is entrance orifice 49 and base plate 45. As shown, cut-away area 54 extends to a greater radial extent than does the periphery of radially off-center entrance orifice 49.

Figure 7A:
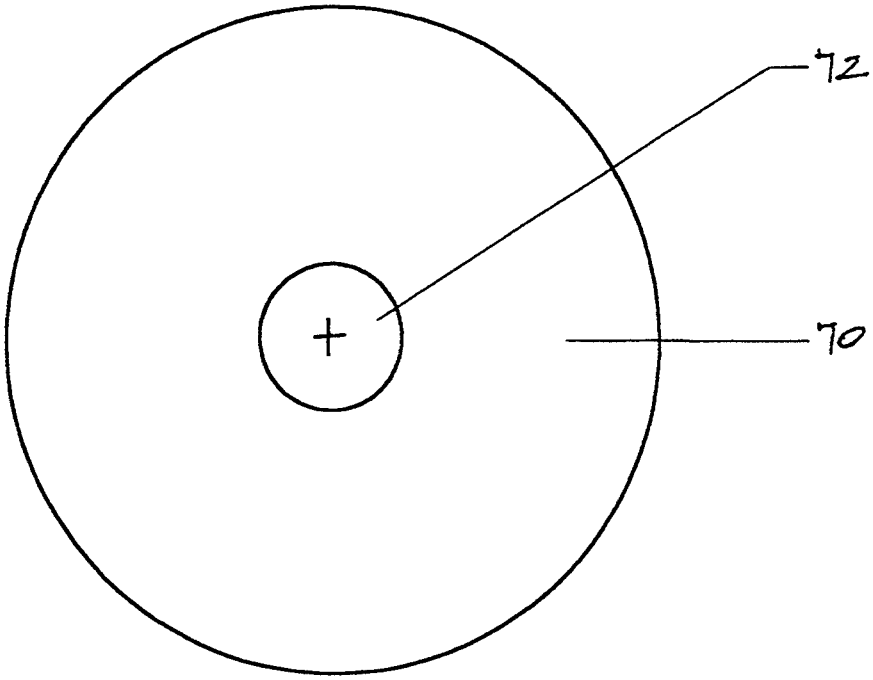
FIG. 7(*a*) is a top view of the circular plate used in the hydraulic cylinder of both the first and second embodiments of this invention.
Figure 7B:
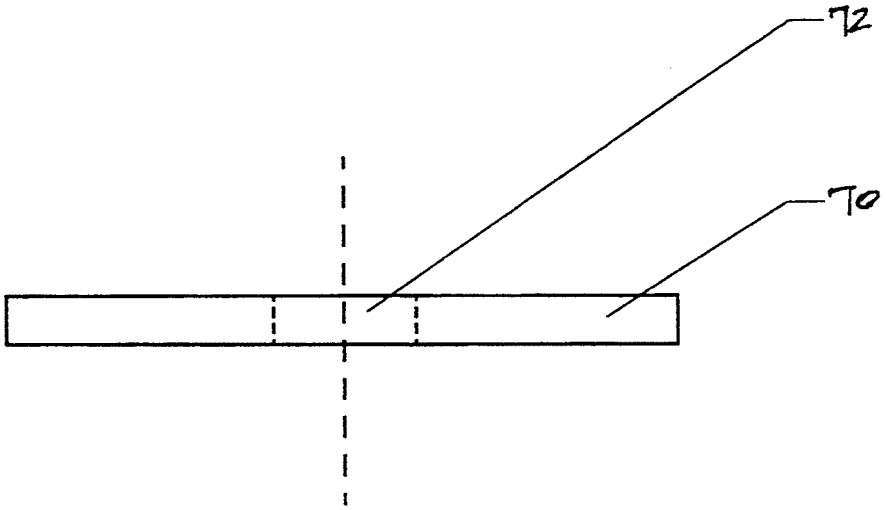

FIG. 7(*a*) is a top view of circular plate 70 of the first embodiment of this invention. Circular plate 70 defines an orifice 72 at a radially central location thereof so as to allow the hydraulic fluid to flow between fixed elongated bleeding tube 56 and cut-away area 54 of base plate 45. Circular plate 70 is disposed between base plate 45 and the lower end of fixed elongated tube 56, with compression spring 62 having its lower axial end resting on and being attached to the top surface of circular plate 70.

FIG. 7(*b*) is a side view of circular plate 70 of FIG. 7(*a*). As shown, plate 70 has a relatively thin profile which is substantially constant through its entire diameter and orifice 72 defined therein is circular with a diameter substantially equal to the inner diameter of fixed bleeding tube 56.

Figure 8A:
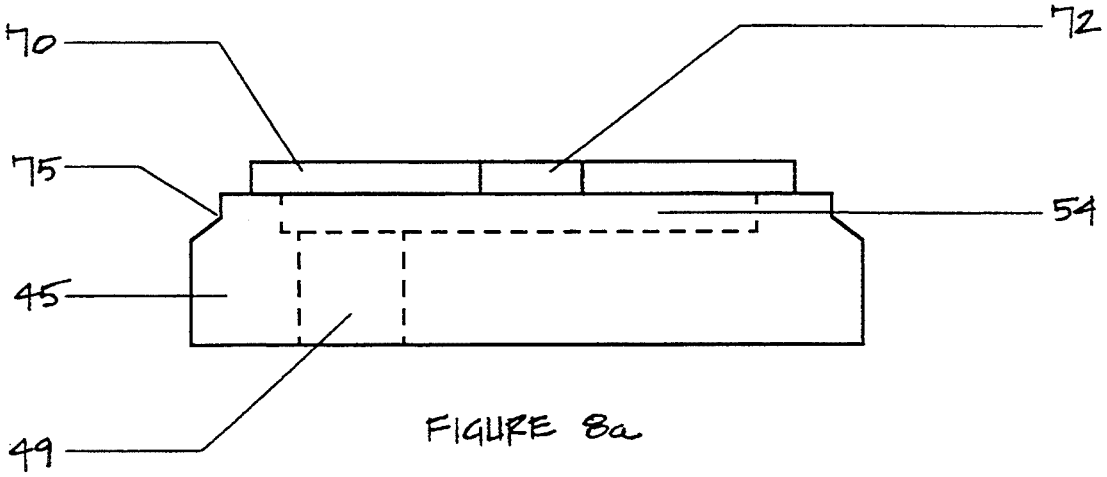
FIG. 8(*a*) is a side view of the combination of the base plate and circular plate of both the first and second embodiments of this invention.
Figure 8B:
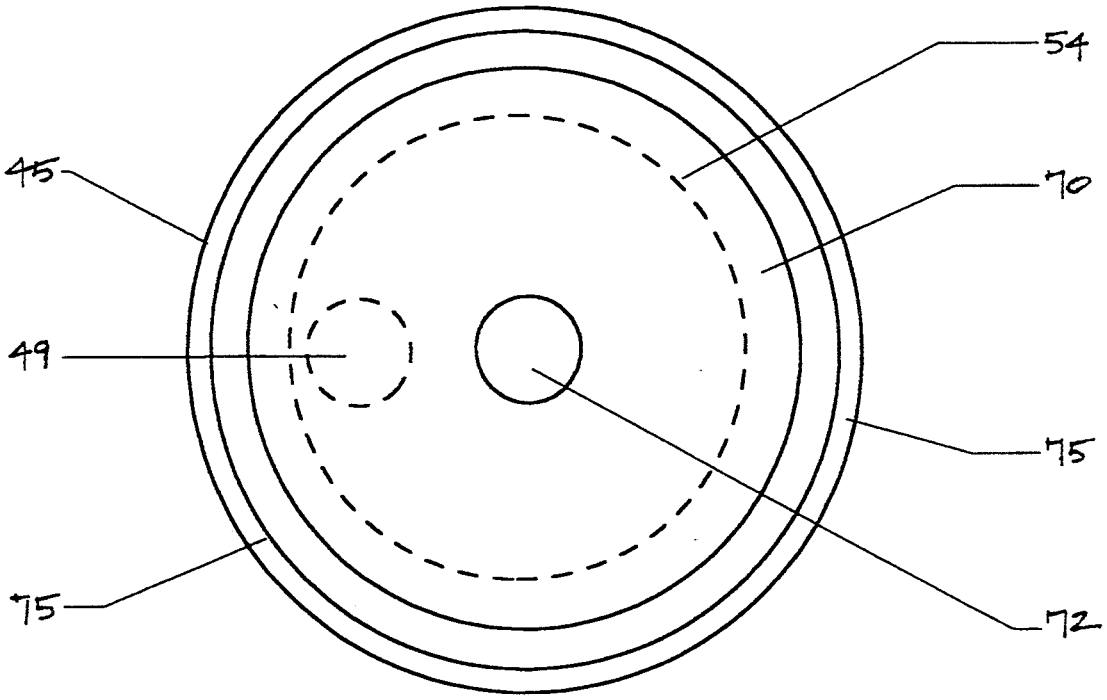

FIG. 8(*a*) is a side view of the combination of base plate 45 and circular plate 70. Circular plate 70 including orifice 72 is affixed over cut-away area 54 defined in base plate 45 so that a hydraulic fluid flow passageway exists between entrance orifice 49 in the base plate and orifice 72 defined in circular plate 70. This design allows the hydraulic fluid to both enter (or leave) base plate 45 by way of port attachment 52 at an off center location and enter (or leave) fixed elongated tube 56 at a location axially central to stage cylinders 41–44.

FIG. 8(*b*) is a top view of the combination of base plate 45 and circular plate 70 affixed thereto as described above and shown in FIG. 8(*a*). As shown, circular plate 70, base plate 45, and the orifices and cut-away voids therein are all substantially circular and concentric to one another with the exception of entrance orifice 49 which has its central axis located radially outward with respect to the other central axes.

Circular plate 70, of course, is optional and need not be used if entrance orifice 49 in base plate 45 is axially aligned with the longitudinal axis of elongated conduit bleed tubes 56 and 58.

Figure 9:
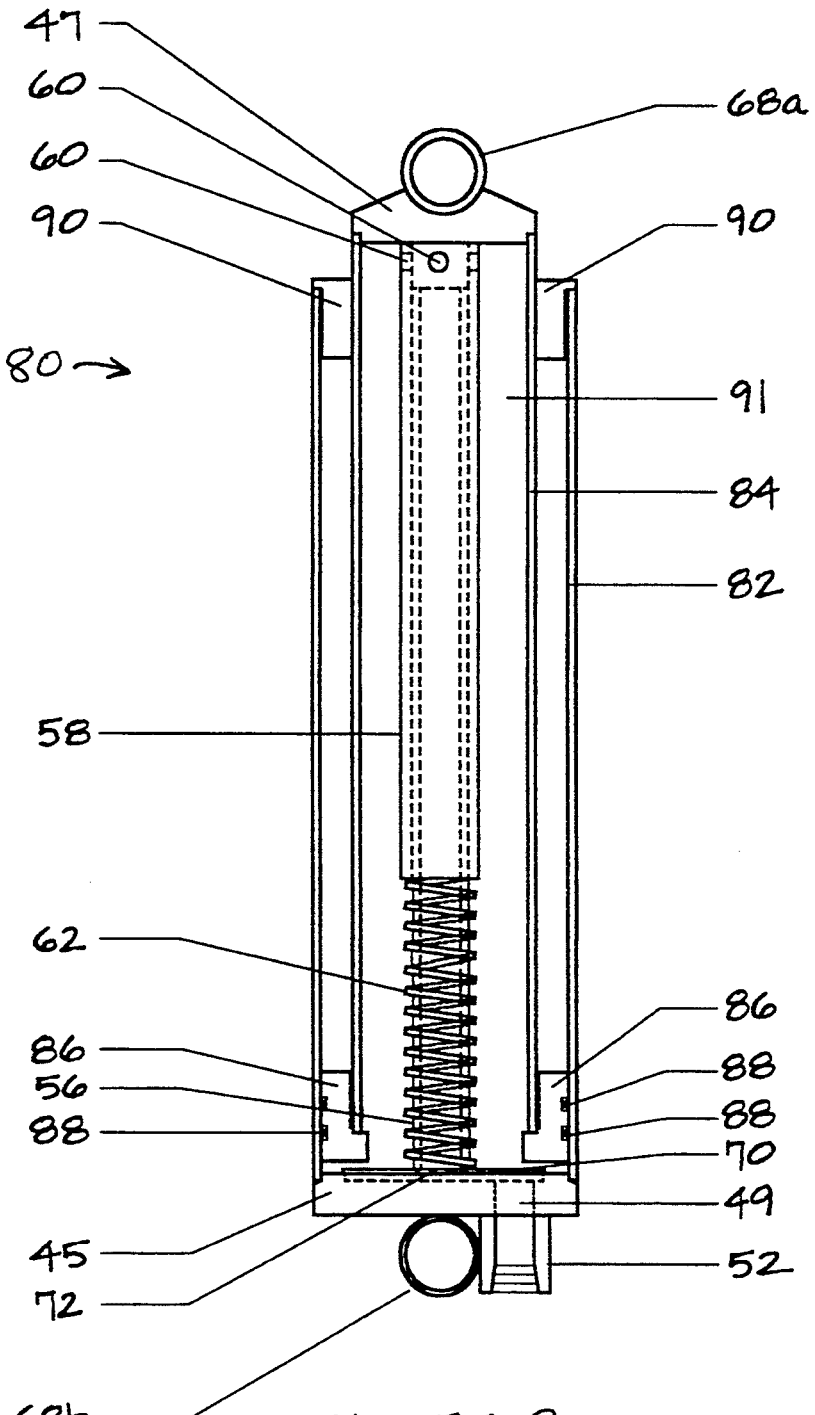
FIG. 9 is longitudinal vertical sectional view of a single-stage hydraulic cylinder in its fully retracted or unexpanded form according to a second embodiment of this invention.
Figure 10:
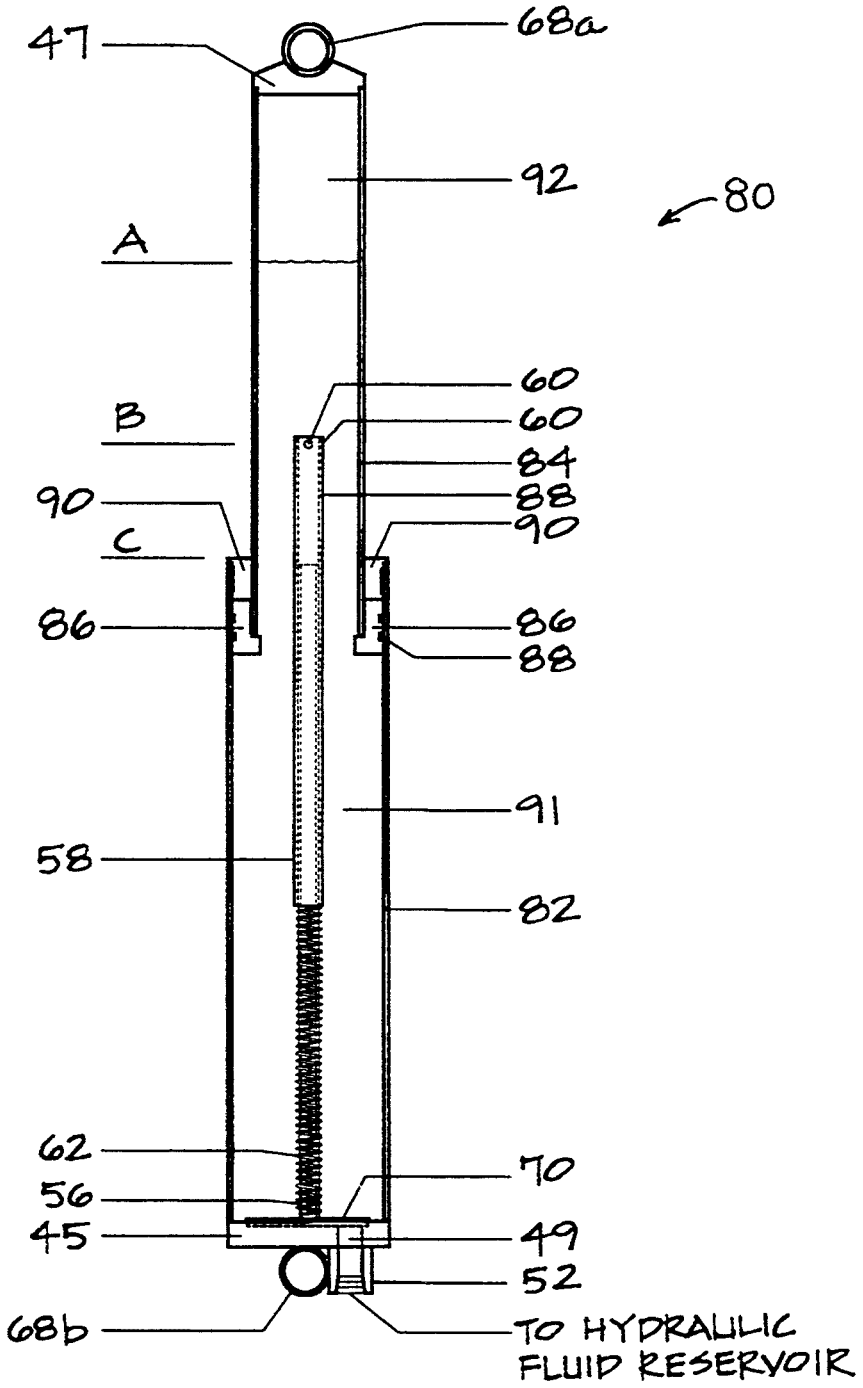
FIG. 10 is longitudinal vertical sectional view of the single-stage hydraulic cylinder of FIG. 9, in its fully extended form.

FIGS. 9–10 are vertical sectional views of a second embodiment of this invention illustrating its adaptability to a single stage cylinder system. This second embodiment includes a single-stage hydraulic cylinder system 80 using the self-bleeding mechanism shown and described in the first embodiment of this invention. FIG. 9 illustrates single-stage cylinder system 80 in its fully retracted or compressed form where cylinder cap 47 is contacting and sealing the open top end of moveable elongated bleeding tube 58 thus pushing it down over fixed elongated bleeding tube 56 against the force of compression spring 62.

The cylinder stack here includes outer stage cylinder 82 and inner stage cylinder 84 with inner stage cylinder 84 having an exterior or outer diameter substantially less than the inner diameter of outer cylinder 82. Base plate 45, circular plate 70, cylinder cap 47, pivots 68, elongated bleed tubes 56 and 58, compression spring 62, port attachment 52, cross-drill orifices 60, and levels "A–C" of this second embodiment are equivalent to those shown and described in the first embodiment of this invention.

Inner-stage cylinder 84 includes a ring member 86 with bearings 88 affixed to the periphery thereof. The provision of ring member 86 allows for the upward extension of inner stage cylinder 84 to be limited or stopped when ring member 86 comes into contact with stop member 90 attached to the upper end of outer cylinder 82. Bearings 88 disposed on the outer periphery of ring member 86 are for reducing resistance and allowing substantially (but not completely) frictionless axial movement between inner and outer stage cylinders 84 and 82 respectively.

A typical operation of this single stage cylinder is carried out as described above with respect to the first embodiment, in that when single-stage hydraulic cylinder system 80 is originally installed, interior 91 of the cylinder is filled with air. The dump truck operator, as described above, activates PTO 115 and valve 123 in order to raise dump bed 102. As conventional hydraulic fluid is pumped into single-stage cylinder 80 through orifices 49 and 72 in base plate 45 and circular plate 70 respectively, inner cylinder 84 is caused to extend axially upward and compression spring 62 pushes axially moveable bleed tube 58 upward to a predetermined extent of about one-third the axial length of fixed bleed tube 56. When moveable conduit tube 58 reaches its predetermined extended position, compression spring 62 is no longer compressed. In other words, compression spring 62 forces moveable tube 58 upward to a predetermined extent or position which is identical regardless of the number of stage cylinders making up the hydraulic cylinder.

After moveable tube 58 has been forced upward to this predetermined extent by spring 62, inner cylinder 84 continues to extend upward to the end of its total stroke as shown in FIG. 10. The air entrapped within interior 91 of single-stage cylinder system 80 will have risen to the top thereof and will be compressed and trapped in air pocket 92. Reference letter "A" shown in FIG. 10, of course, represents an exemplary level of hydraulic fluid within cylinder 80 above which is air pocket 92.

Entrapped air within the cylinder system may now be bled therefrom in a manner similar to that previously described with respect to the first embodiment of this invention. As the single stage cylinder begins to retract from its extended form, hydraulic fluid between levels "A" and "B" will enter the open top end of moveable bleed tube 58 and continue downward through the interior of fixed bleed tube 56 into hydraulic fluid reservoir 127 via orifice 49. As the hydraulic cylinder continues to retract, when levels "A" and "B" are equivalent, the compressed air within pocket 92 begins to be forced through cross-drilled orifices 60 and downward through tubes 58 and 56 respectively, eventually exiting port 52 and proceeding back into fluid reservoir 127. When cylinder cap 47 finally contacts the top end of moveable tube 58 creating a seal therebetween, substantially all of the entrapped air which was present in the cylinder will have been exhausted therefrom, some of which will still be entrapped within tubes 56 and 58. As inner cylinder 84 continues to move downward, the hydraulic fluid between levels "B" and "C" will be forced through cross-drilled orifices 60 in moveable tube 58 and downward through bleeding tubes 58 and 56 into fluid reservoir 127, thus flushing the air within tubes 56 and 58 back into reservoir 127. Due to the length of spring 62, there is enough fluid between levels "B" and "C" to ensure that the air within tubes 56 and 58 is forced all the way back into the reservoir.

Figure 11:
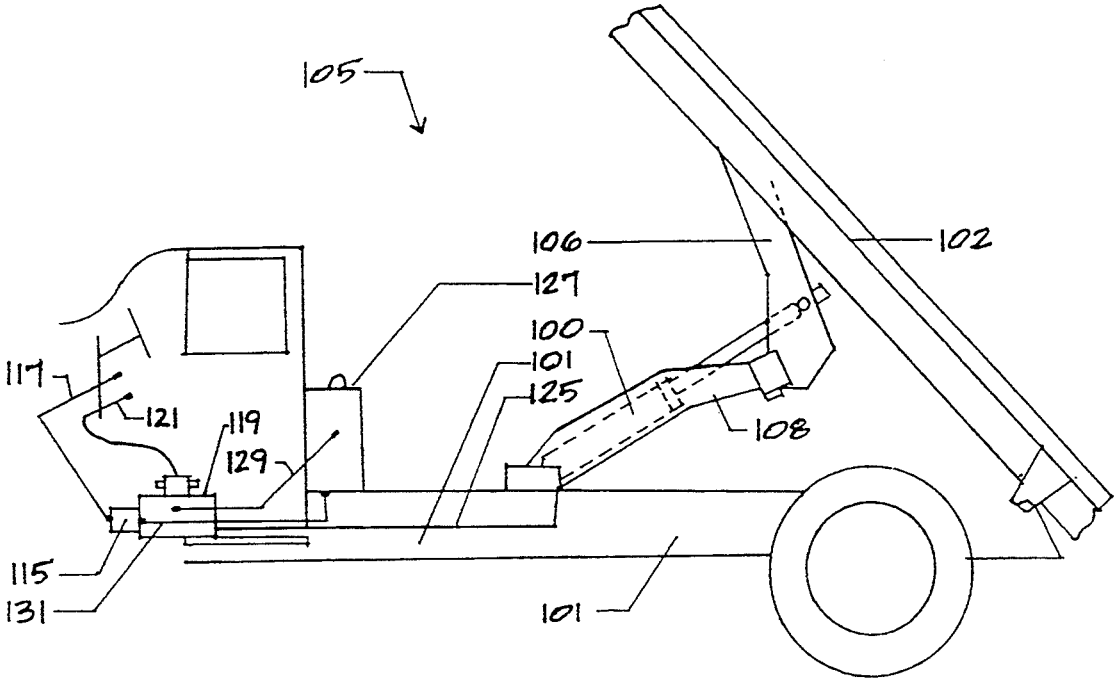
FIG. 11 is a side view of a self-bleeding hydraulic cylinder according to an embodiment of this invention mounted on a truck and used in a dump body hoist assembly, including a schematic diagram of the bleed system components.

FIG. 11 illustrates a self-bleeding hydraulic cylinder 100 according to an embodiment of this invention mounted on a typical truck chassis 101 as part of a hoist assembly, including a schematic diagram of the aforesaid described bleeding system components. Cylinder 100 is mounted so as to lift dump bed 102 when hydraulic fluid is pumped from reservoir 127 by way of pump 119 into cylinder 100. PTO 115 powers pump 119. The preferably integral arrangement of PTO 115 and pump 119 eliminates the need for a driveline between the PTO and the pump. Typically, PTO 115 and valve 123 are controlled (i.e. shifted) by levers 117 and 121, respectively, provided in the cab.

Fluid from reservoir 127 makes its way to pump 119 as by suction line 131. When valve 123 is opened, pump 119 forces fluid via hydraulic line 125 into cylinder 100. After cylinder 100 reaches the end of its extension stroke, when bed 102 is lowered, fluid is forced from cylinder 100 as previously described back into reservoir 127 by way of hydraulic line 125 and return line 129.

Hoist assembly 105 includes upper arms 106 and lower arms 108 which combine with self-bleeding cylinder 100 to lift and lower dump body 102. Hydraulic cylinders according to different embodiments of this invention may, of course, be used in dump body hoists in accordance with the specific needs of the hoist.

Alternatively, a hydraulic cylinder according to this invention could have a separate return line interfacing reservoir 127 with the hydraulic cylinder. In such a design, hydraulic fluid would be pumped into the cylinder interior by way of one hydraulic line, and extracted from the cylinder via a separate return line. This would allow the cylinder to be designed such that the fluid between levels "B" and "C" need not be sufficient to push the extracted air all the way back to reservoir.

While the two embodiments of this invention shown and described above describe the self-bleeding structure in conjunction with "gravity down" cylinders, the self-bleeding structure of this invention can also be used in "power down" type hydraulic cylinders.

This invention will now be described with respect to the following example.

EXAMPLE

A three-stage hydraulic cylinder, Model No. T63131 manufactured by Crysteel, Inc., is equipped with the self-bleeding system shown in FIGS. 4–8. The cylinder is originally installed free of hydraulic fluid, but full of uncompressed air, (i.e. 825.6 $in^3$). This example assumes that all air is uncompressed. The volume of air entrapped in the cylinder includes the volume disposed between the stage cylinders. In order to "bleed" the entrapped air from within the cylinder, hydraulic oil is for the first time pumped into the cylinder until the first stage reaches the end of its extending stroke. Cylinder expansion is stopped at this point by cutting off the in-flow of hydraulic oil into the cylinder. At the end of this first stage extension, the cylinder is filled with 825.6 $in^3$ of uncompressed air and 1037.3 $in^3$ of hydraulic oil.

The bleed procedure is now carried out by retracting the first stage to its rest position by permitting the hydraulic oil to leave the cylinder by way of the bleed conduits (i.e. tubes) and the orifice defined in the base plate. As the oil exits the cylinder in such a manner, the first stage retracts to the point where the oil level is immediately adjacent the bottom of cross-drilled orifices 60 (i.e. where level "A" equals level "B"). At this point, enough hydraulic oil remains between levels "B" and "C" to "chase" the uncompressed air out of 22.5 feet of one inch ID hydraulic hose affixed to the base plate as the first stage continues to retract until reaching its rest position. As will be understood by those of skill in the art, the reservoir will be disposed at a position such that substantially all of the uncompressed air is "chased" to a point from which it is permitted to reach and be vented by the reservoir. Preferably, less than the aforesaid 22.5 feet of hose is disposed between the cylinder and the reservoir so that the hydraulic fluid "chases" all of the uncompressed air back to reservoir and out of the hydraulic system.

After this one-stage bleed procedure, there is about 10 $in^3$ of entrapped air remaining within the cylinder due to (i) the air volume present between the outer and first stage cylinder walls, and (ii) the air present in "solution" as small bubbles. An additional bleed cycle would purge this remaining air from the cylinder.

If the full three-stage extension (as opposed to the aforesaid one stage) were instead performed as the initial bleed, there would be a complete purge of air with one cycle regardless of the pressure.

It can be seen from the above recited example that during an initial single stage extension and retraction, approximately 99% of the air entrapped within the three-stage cylinder is bled therefrom by way of the aforesaid single-stage bleeding procedure. Because the aforesaid example assumed that all air is uncompressed, it is very conservative in nature. If one were to assume that the 825.6 $in^3$ of air originally present within the installed cylinder was compressed by the initial charge of hydraulic oil, it would appear to be a safe bet that the initial single-stage cycle would purge about 100% of the air from the cylinder instead of the aforesaid 99%.

It will be clear to those of skill in the art that parameters such as the size of the compression spring, moveable tube, fixed tube, etc. may be adjusted without adversely affecting the functionality of this invention.

It will be further understood that when hydraulic cylinders are intended to be used in an inverted position, the fixed bleeding tube and corresponding porting can be fixedly attached to the base plate disposed at the stationary end of the smallest stage (the stage cylinder with the smallest diameter), which in turn would be pivotally attached to, for example, a truck frame. In other words, the base plate would be attached to the smallest stage cylinder instead of the largest stage cylinder and the cylinder cap would be affixed to the extending end of the largest stage cylinder. In either case, the fixed bleeding tube is fixedly connected inside the hydraulic cylinder to the center of the base plate (including the optional circular plate) disposed at the bottom or base end of the cylinder and hydraulic fluid is introduced into the cylinder via an entrance orifice in the base plate.

The terms "bottom" and "lower" as used herein mean the side or end of the described element nearest the fixed or non-expanding base portion of the hydraulic cylinder.

Likewise, the terms "upper" and "top" as used herein mean the side or end of the described element furthest from the stationary base of the cylinder and closest to the extendable end (or cylinder cap end) of the cylinder.

It will also be understood to those of skill in the art that while both the single-stage and multi-stage hydraulic cylinders of this invention are preferably used in hydraulic truck bed hoist assemblies, they may also be used in all other environements in which hydraulic cylinders are used.

The above described and illustrated structural elements of the first and second embodiments of this invention are manufactured and connected to one another by conventional methods commonly used throughout the art.

Once given the above disclosure, therefore, various other modifications, features or improvements will become apparent to the skilled artisan. Such other features, modifications and improvements are thus considered a part of this invention, the scope of which is to be determined by the following claims:

I claim:

1. A self-bleeding extendable and retractable hydraulic cylinder system comprising:

a base plate having attached thereto a first stationary cylinder and having located therein an orifice in communication with one axial end of said cylinder;

a second cylinder coaxial with said first cylinder and extendable with respect to said first cylinder, said second cylinder having in one end thereof a pocket within which air may become entrapped;

a self-bleeding mechanism disposed within the hydraulic cylinder system for enabling entrapped air to escape from said pocket, said self-bleeding mechanism including a first stationary conduit means, said first conduit means having a first end fixedly attached to said base plate, said orifice in said base plate in communication with said first conduit means; and a second conduit means coaxial with said first conduit means, said second conduit means being extendable and retractable with respect to said first conduit means and being opened to flow communication at both its ends; and biasing means for extending said second conduit means to a predetermined extended position relative to said first conduit means such that when the hydraulic cylinder system is being retracted from an extended state one end of said second conduit means will be in communication with said pocket for enabling entrapped air to bleed from the hydraulic cylinder system.

2. The hydraulic cylinder system of claim 1, wherein said first conduit means of said self-bleeding mechanism includes a fixed elongated tube having its bottom end attached to said base plate, said second conduit means includes an axially moveable elongated tube telescopically connected to said fixed elongated tube, and said biasing means includes a spring which biases said axially moveable elongated tube upwardly away from said base plate to said predetermined extended position when said hydraulic cylinder is in the extended state.

3. The hydraulic cylinder system of claim 2, wherein said axially moveable elongated tube has a periphery with at least one orifice therein near the upper end thereof, whereby hydraulic fluid and air to be bled from the hydraulic cylinder system enter said self-bleeding mechanism from the interior of the hydraulic cylinder through said at least one orifice in, and an open top end of, said axially moveable elongated tube.

4. The hydraulic cylinder system of claim 3, wherein said fixed and moveable elongated tubes are substantially coaxial with said first and second cylinders.

5. The hydraulic cylinder system of claim 4, wherein said orifice in said base plate allows hydraulic fluid from a fluid reservoir to enter said interior of said hydraulic cylinder via said moveable and fixed elongated tubes.

6. The hydraulic cylinder system of claim 5, further comprising a circular plate disposed between said fixed elongated tube and said base plate, wherein said circular plate defines an orifice in a center portion thereof which allows said entrapped air and hydraulic fluid to flow between said fixed elongated tube and said orifice in said base plate.

7. The hydraulic cylinder system of claim 6, wherein said base plate is substantially circular and said orifice therein is not substantially coaxial with said orifice in said circular plate, and wherein said base plate further includes a cut-away area defined therein which allows said hydraulic fluid to flow between said base plate orifice and said orifice in said circular plate.

8. The hydraulic cylinder system of claim 4, wherein said fixed elongated tube has an outer diameter smaller than an inner diameter of said axially moveable elongated tube such that said moveable elongated tube slidingly fits over said fixed elongated tube.

9. The hydraulic cylinder system of claim 1, further comprising a third intermediate stage cylinder disposed between said first and second cylinders, said intermediate stage cylinder having an outer peripheral diameter smaller than the inner diameter of said first cylinder and an inner diameter larger than the outer diameter of said second cylinder, whereby said hydraulic cylinder is of the multi-stage telescopic type.

10. The hydraulic cylinder system of claim 2, further comprising a cylinder cap that closes the top axial end of said second cylinder, wherein said cylinder cap contacts said axially moveable elongated tube when said second cylinder is in a retracted position with respect to said first cylinder, whereby said cylinder cap forces said axially moveable tube downward toward said base plate against the force of said biasing means when said second cylinder is in said retracted position.

11. The hydraulic cylinder system of claim 10, wherein the axial length of said axially moveable elongated tube is about two-thirds the axial length of the fixed elongated tube, and the vertical axial length of said spring when in its noncompressed expanded form is about two-thirds the axial length of said fixed elongated tube.

12. The hydraulic cylinder system of claim 10, wherein said cylinder cap has a pivot member attached thereto for mounting a load thereon.

13. A truck dump body hoist assembly adapted to be mounted on a truck chassis, said hoist assembly including the self-bleeding hydraulic cylinder system of claim 1.

* * * * *